US007794102B2

(12) United States Patent
Shemwell et al.

(10) Patent No.: US 7,794,102 B2
(45) Date of Patent: Sep. 14, 2010

(54) LED DAZZLER

(76) Inventors: David M. Shemwell, 15538 SE. 79th Pl., Newcastle, WA (US) 98059; Weihao Alexander Long, 218 Main St., #271, Kirkland, WA (US) 98033-6108; Michael Perry Challenger, 21015 9th Ave., SE., Bothell, WA (US) 98021; Robert Lee Fuhriman, Jr., 11217 E. Riverside Dr., Bothell, WA (US) 98011; Donald Limuti, 109 Lake St., #4, Kirkland, WA (US) 98033

( * ) Notice: Subject to any disclaimer, the term of this patent is extended or adjusted under 35 U.S.C. 154(b) by 0 days.

(21) Appl. No.: 12/152,539

(22) Filed: May 15, 2008

(65) Prior Publication Data

US 2009/0284961 A1 Nov. 19, 2009

(51) Int. Cl.
*F21V 33/00* (2006.01)

(52) U.S. Cl. ..... 362/109; 362/184; 362/112; 362/545

(58) Field of Classification Search ..... 362/184, 362/249.02, 555, 545, 109, 800, 259, 553, 362/112
See application file for complete search history.

(56) References Cited

U.S. PATENT DOCUMENTS 4,186,857 A * 2/1980 Helms, Jr. ..... 223/94
5,373,427 A * 12/1994 McLean ..... 362/96
5,752,766 A * 5/1998 Bailey et al. ..... 362/249.04
7,040,780 B2 * 5/2006 Diehl ..... 362/259
7,220,957 B2 * 5/2007 Choi et al. ..... 250/221
7,497,586 B2 * 3/2009 Eisenberg et al. ..... 362/109
2002/0006039 A1 * 1/2002 Ueda et al. ..... 362/217
2002/0105805 A1 * 8/2002 O'meara ..... 362/259
2006/0234191 A1 10/2006 Ludman

* cited by examiner

*Primary Examiner*—Ali Alavi
(74) *Attorney, Agent, or Firm*—Anthony Claiborne

(57) ABSTRACT

An apparatus produces a "dazzling" effect: disorientation and temporary and fully reversible blindness in subjects for the purpose of threat deterrence in both civilian law enforcement and military engagements without the use of lasers. A plurality of light emitting diodes (LEDs) capable of intense illumination is provided. Light emitted by each LED is pulsed and focused by reflective optics to produce a pulsed beam of sufficient intensity that the combined effect of the beams from the LEDs induces dazzling in subject viewers in the target range. Further included in or ancillary to the invention are a power source for powering the LEDs a signal source and controller for controlling their illumination and pulsing, and a shield suitable for protecting a user against projectiles.

8 Claims, 7 Drawing Sheets

LED DAZZLER

LICENSE RIGHTS

The U.S. Government has a paid-up license in this invention and the right in limited circumstances to require the patent owner to license others on reasonable terms as provided for by the terms of Contract No. RDECOM-ARDEC W25QKN-05-C-1031 awarded by the U.S. Army.

BACKGROUND OF THE INVENTION

1. Field of the Invention

This invention relates generally to systems of light sources and more particularly to non-lethal weapon systems comprised of light-emitting diodes for dazzling or stunning humans.

2. Description of the Related Art

In both civilian law enforcement and military action, it is often necessary for enforcers to render a hostile opponent harmless without causing death or permanent injury to the subject. Such non-lethal threat deterrence employed at present includes high-voltage electrical weaponry sold under the trademark Taser®, high-pressure water jets or water cannons, and aerosol or gas dispersed chemical irritants such as CN and CS tear gases, pepper-spray, and the like. Each of the forgoing methods for non-lethal threat deterrence has significant shortcomings.

While Tasers are routinely employed in domestic civilian law enforcement to subdue individual opponents, because the operation of a standard Taser projects a wired electrical connection between a voltage source (typically part of the Taser apparatus held by the user) and the dart propelled into the skin of the subject, it is not well suited to crowd control situations with more than a few subjects. Further, Tasers have a limited range, nominally on the order of 32 feet, rendering them unsuitable for subduing more distant subjects.

Furthermore, while Tasers and related electro-shock weapons are not technically considered lethal, some governmental authorities as well as some non-governmental organizations question the safety of the use of Tasers. Yet further some civilian organizations, such as Amnesty International, allege that the use of these weapons is inhumane and unethical and call for a moratorium on their use until further research establishes that they may be safely and humanely deployed.

There are serious safety concerns about the use of water cannon for riot control as well. A modern water cannon can produce streams of water at extremely high water pressures (up to 435 pounds per square inch), which is capable of breaking subject's bones and causing significant injury to internal organs such as the spleen. Further, in much of the free world the use of such weapons has negative associations with official oppression because of their extensive employment in suppressing unarmed civil rights protesters both in the United States and abroad.

Tear gases and related irritants are typically administered to subjects by dispersal as a gas or aerosol into the surroundings of the subjects. Such agents cause irritation and pain to the subject's eyes, respiratory system and skin, inducing the subject to leave the area of dispersal. Because the use of dispersed irritants causes pain in the subjects, it is regarded by some organizations as inhumane and unethical. Further, some evidence exists that prolonged exposure to such chemical irritants may cause interstitial scaring in the respiratory system of subjects. Yet further, because these agents are generally dispersed into in a particular area, they are non-discriminatory in effect (causing pain to hostiles and non-hostiles alike in the affected area). And yet further, the value of chemical irritants for crowd control is limited by weather conditions, a shift in wind or heavy precipitation significantly limiting the effectiveness of such agents.

It has long been observed that brief exposure to high intensity light can have the effect of momentarily blinding a viewer after the light source is removed, so much so that the viewer can become disoriented or "dazzled". Further, it has more recently been observed that brief exposure to flashing or pulsed high intensity light enhances this dazzling effect, significantly lowering the threat posed by such a subject. Efforts heretofore made to create a dazzling effect for non-lethal threat deterrence have had mixed results.

Diehl, in U.S. Pat. No. 7,040,780, describes a laser dazzler matrix, comprised of a plurality of laser light sources to produce a plurality of illumination zones. Projecting Diehl's laser matrix at a subject viewer is said to induce dazzling in the subject. Laser dazzlers such as Diehl's require substantial power supplies to provide the current and voltage needed to power the lasers, limiting the mobility of such devices.

Diehl describes embodiments of his invention that would conform to the Maximum Permissible Exposure Limits for exposure to laser light, as set forth in ANSI Z 136.1. Notwithstanding such limits, the use of blinding laser weapons is banned by international treaty (the 1995 United Nations Protocol on Blinding Laser Weapons). The humanitarian organization, Human Rights Watch, has opposed the use of laser dazzlers generally, taking the position that even lower powered lasers have the potential to cause permanent injury and has recommended that the United States discontinue all ongoing research and development of tactical laser weapons because of their potential use as blinding antipersonnel weapons. The organization has further requested that existing prototypes of tactical laser weapon systems be destroyed. While field commanders in military action abroad have requested dazzler technology to add to their arsenal of non-lethal weaponry, in response to humanitarian concerns and controversy surrounding the safety of laser weaponry generally, the adoption of laser dazzler technology by both military forces and civilian police forces has been relatively low.

What is needed is a dazzler technology that demonstrably produces no long-term health effects. What is needed further is an effective dazzler technology that does not rely on lasers for its light source. What is yet further needed is an effective dazzler technology with significantly lower power requirements than those for laser-based dazzlers.

BRIEF SUMMARY OF THE INVENTION

The present invention is an apparatus for producing a "dazzling" effect: disorientation and temporary and fully reversible blindness in subjects for the purpose of threat deterrence in both civilian law enforcement and military engagements. The apparatus is comprised of a plurality of light emitting diodes (LEDs) capable of intense illumination. Light emitted by each LED is further pulsed and focused by reflective optics to produce a pulsed beam of sufficient intensity that the combined effect of the beams from the LEDs induces dazzling in subject viewers in the target range. Further included in or ancillary to the invention are a power source for powering the LEDs and a signal source and controller for controlling their illumination and pulsing. Embodiments of the invention include riot shield, hand held and vehicle-mounted dazzlers.

BRIEF DESCRIPTION OF THE SEVERAL VIEWS OF THE DRAWINGS

The foregoing objects, as well as further objects, advantages, features and characteristics of the present invention, in addition to methods of operation, function of related elements of structure, and the combination of parts and economies of manufacture, will become apparent upon consideration of the following description and claims with reference to the accompanying drawings, all of which form a part of this specification, wherein like reference numerals designate corresponding parts in the various figures, and wherein:

DETAILED DESCRIPTION OF THE INVENTION

The present invention may be implemented in a number of form factors. Common to all embodiments, however, are an array of light emitting diodes driven by driver circuitry supplied with power from a power supply and operating in response to a signal source.

Figure 1:
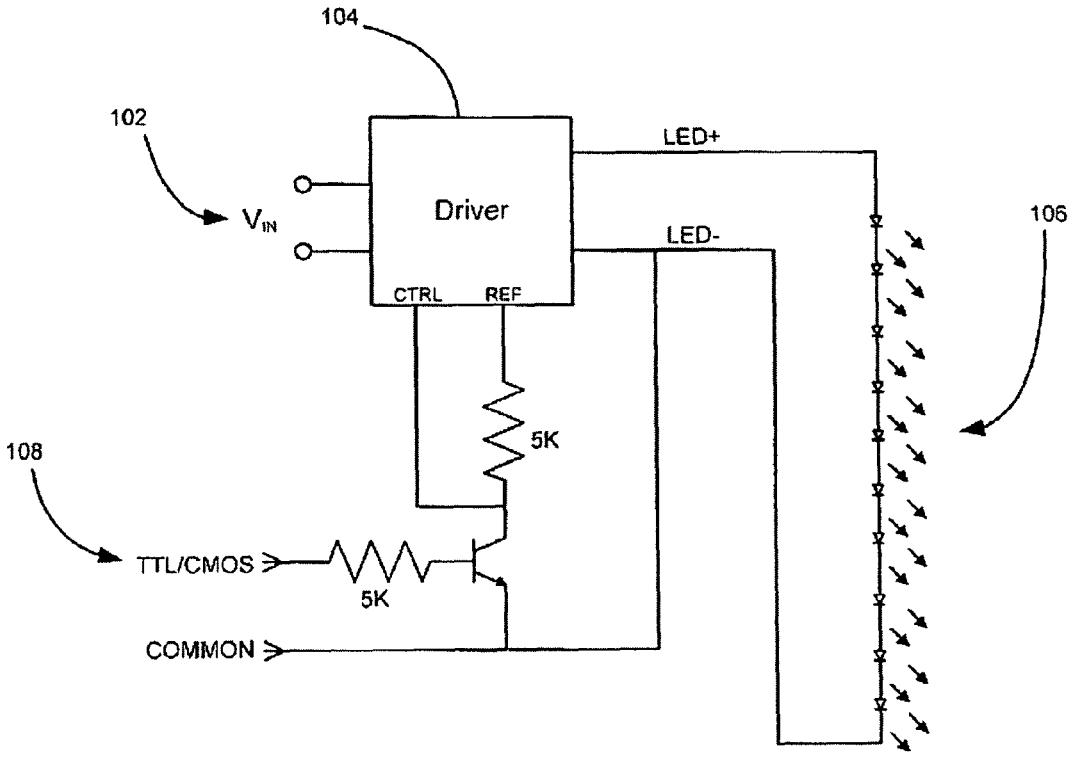
FIG. 1 is a schematic of LED driver circuitry for an embodiment of the present invention.

Turning to FIG. 1, illustrated is schematic electronic circuitry for a driver circuit powering an array of light emitting diodes. Power 102 is supplied to LED driver 104. In many applications, the dazzler device must be mobile and so typically the source of power 102 is a form of battery or fuel cell capable. It should be noted in any case that the amount of power necessary to drive an LED dazzler is considerably less than that for laser dazzlers and accordingly the power supplies for embodiments of the present invention may be much smaller and lighter than power supplies for laser based dazzlers.

In preferred embodiments, driver 104 should be pulse/strobe capable and should drive LEDs with constant current, resulting in maximized efficiency of the apparatus and service life of the LEDs. One such driver, suitable for arrays of up to 12 LEDs, is the BoostPuck 4015 of LEDdynamics of Randolf, Vt. As will be appreciated by those of skill in the art, depending upon the type of LEDs employed in the array, embodiments having a larger number of LEDs may require a plurality of drivers. In the depicted embodiment, when signal source 108 provides a TTL/CMOS signal of +5V DC, driver 104 provides constant current power to LED array 106, causing LED array 106 to illuminate until signal source 108 provides a signal of +0V DC, at which time driver 104 cuts power to LED array and the LEDs cease illumination.

For the present invention, pulsed light may be more effective than a steady beam in inducing a dazzling effect. By providing a pulsed TTL/CMOS signal at source 108, the apparatus drives pulsed illumination of LED array 106. Embodiments may employ varying frequencies of pulsed light for effective dazzling. For embodiments employing the circuit depicted in FIG. 1, effective dazzling is obtained with frequency of signal source 108 varying from about 3 to about 12 hertz. For applications such as civilian crowd control, where minimizing harm to targets is of particular importance, the frequency range of 16-25 hertz should be avoided because of the higher probability of inducing photosensitive epileptic seizures in susceptible subjects viewing light pulsed in that frequency range.

LEDs employed in the present invention should produce high intensity visible radiation, typically on the order of 40 to 60 lumens per diode. Because targets may employ a narrow-band chromatic filter to reduce the dazzling effect of a monochromatic LED dazzler, it may be preferred in some embodiments to employ a plurality of LEDs emitting differing wavelengths for such applications.

Figure 2A:
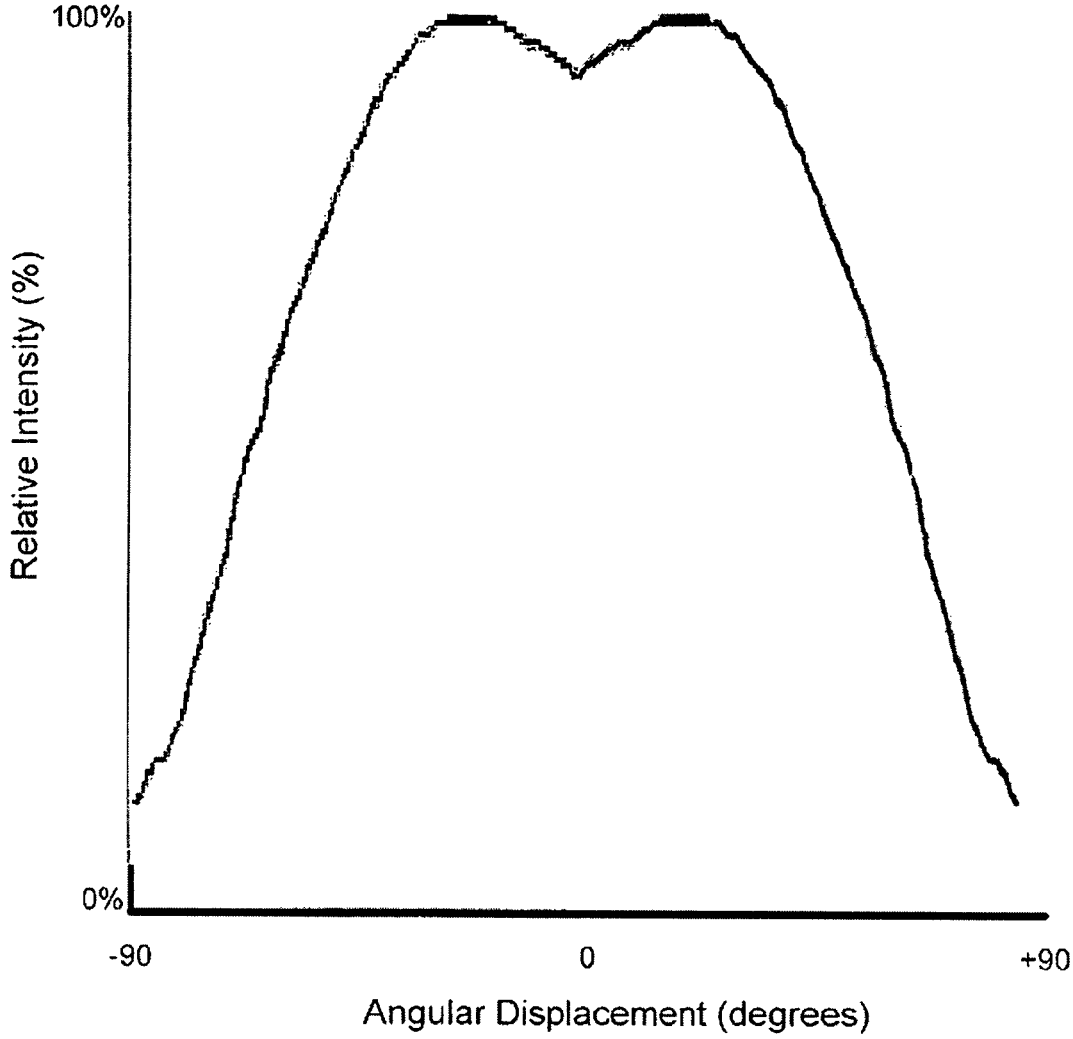
FIGS. 2*a* and 2*b* are graphs illustrating light distribution patterns for LEDs in preferred embodiments of the present invention.
Figure 2B:
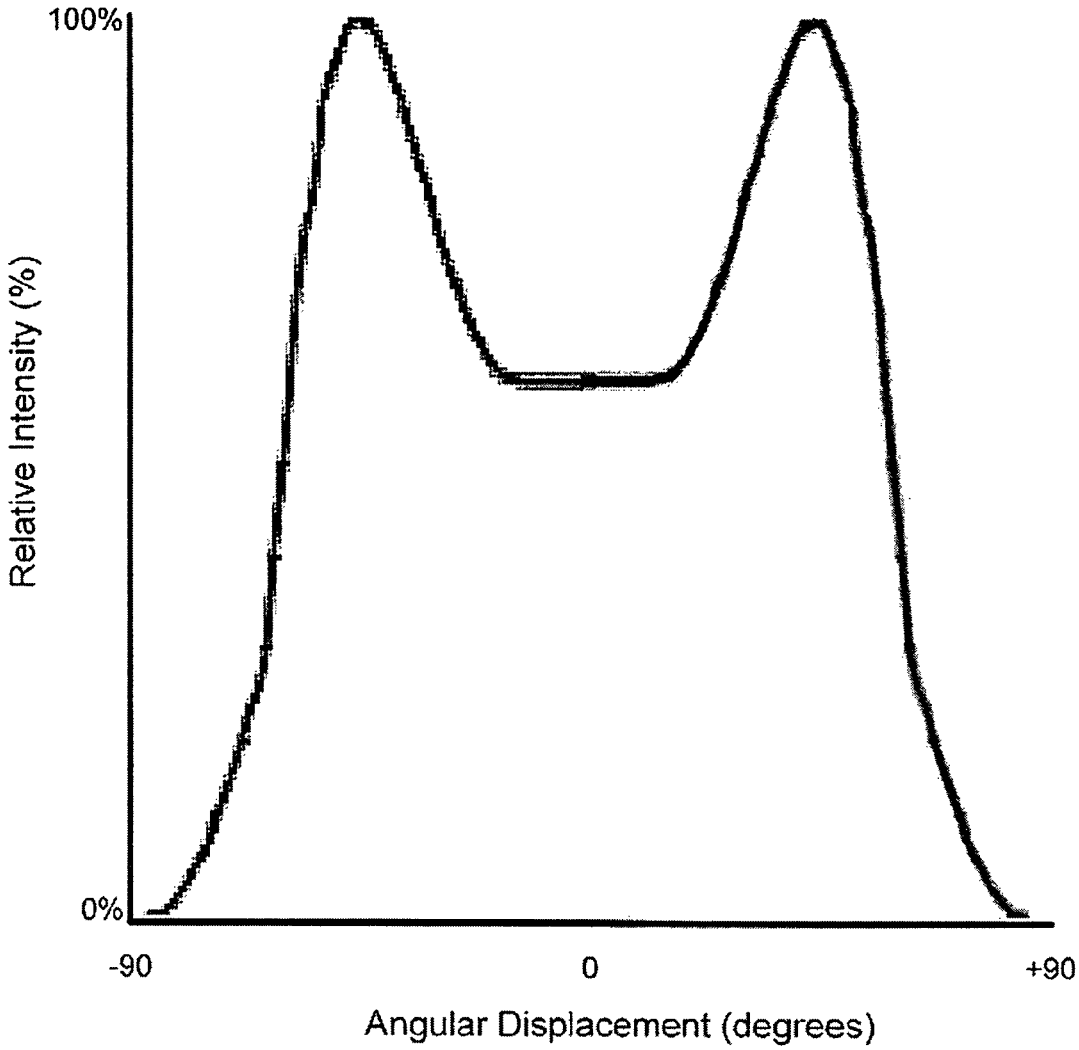

For most embodiments, the LEDs should have relatively wide light distribution patterns and no significant "cold spots" within the projection area. For such embodiments, LEDs with distribution patterns such as lambertian (FIG. 2*a*) or batwing (FIG. 2*b*) are preferred. Luxeon® LEDs, produced by Philips Lumileds Lighting Company of San Jose, Calif. are presently available with such characteristics.

The effectiveness of the LED illumination in inducing dazzling in target subjects is enhanced by appropriate optics that focus or concentrate the illumination from the LED to the target area. Depending upon the form factor of the device, the configuration of the optics for the LED dazzler may vary.

Figure 3:
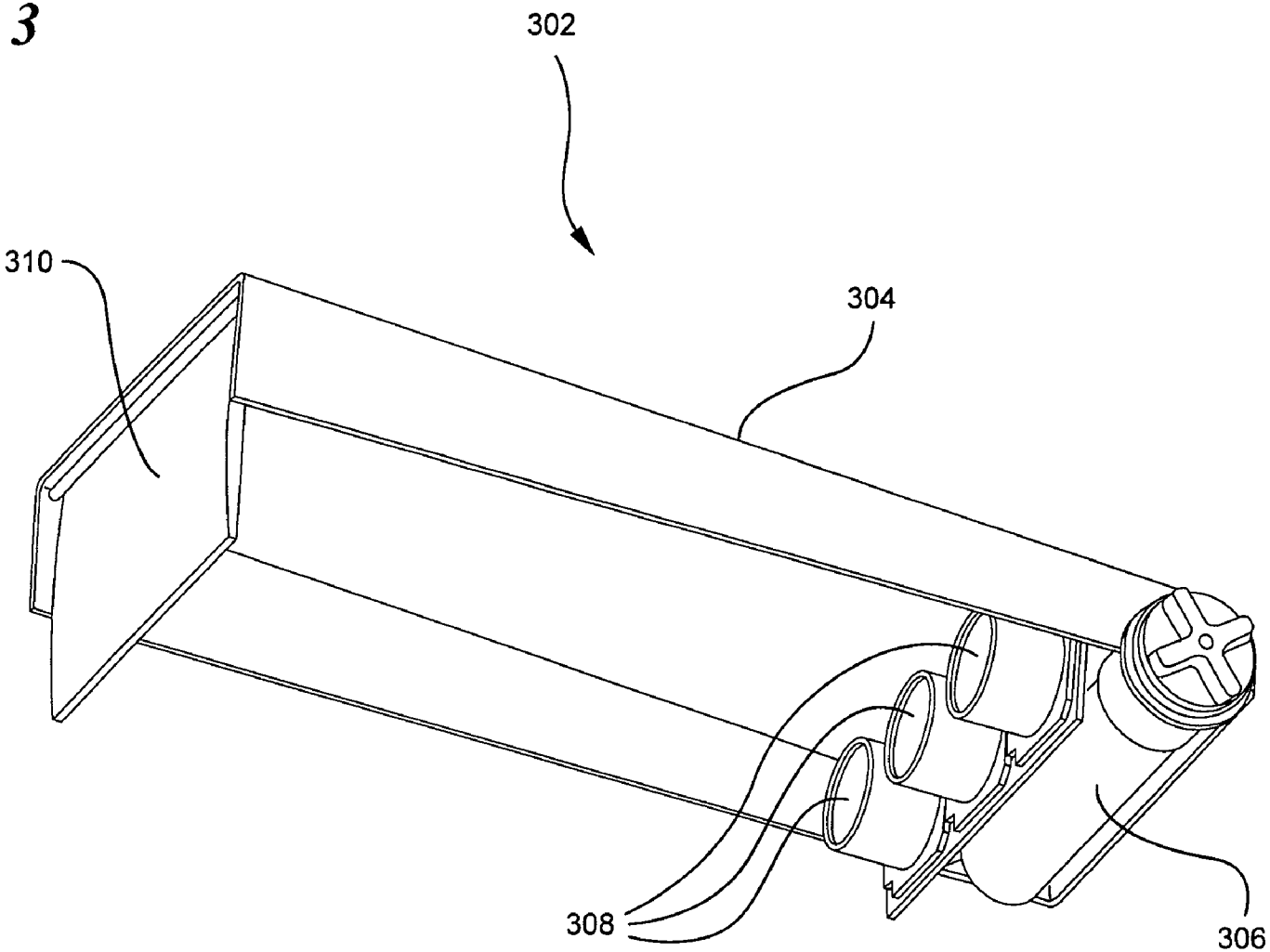
FIG. 3 is a representation of the interior of one embodiment of the present invention illustrating optics.

FIG. 3 illustrates the form factor of a long-range dazzler 302, which may be outfitted with hardware (not shown) for either hand-held or vehicle-mounted operation. Dazzler 302 comprises a housing 304. In the illustrated embodiment, disposed within housing 304 is compartment 306 with power supply and driver circuitry, such as described above in reference to FIG. 1, for driving an array of three LEDs 308. Light pulsing from LEDs 308 is focused by cylindrical lens 310, resulting in a high intensity pulsing beam of light capable of dazzling a target viewer. A number of optical means may be employed for focusing or concentrating the illumination from the LEDs, depending upon the configuration of the dazzler and the range of the target. Such means include cylindrical lens, as described above in reference to FIG. 3, as well as other refractive and reflective means to focus or collimate light, as is well known to those of skill in the optical arts.

Figure 4A:
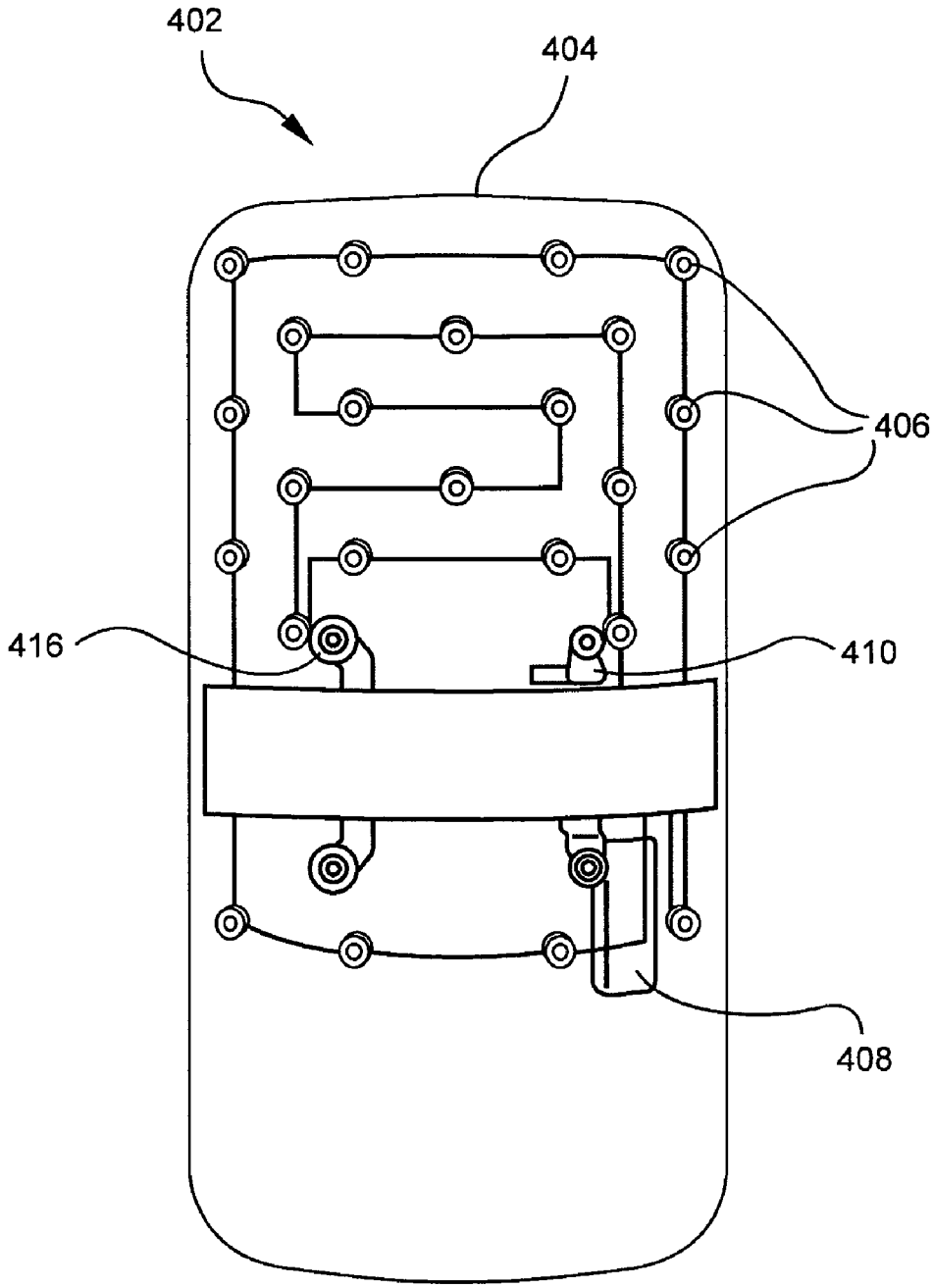
FIGS. 4*a* and 4*b* illustrate an embodiment of the present invention as a shield for military or law enforcement personnel.
Figure 4B:
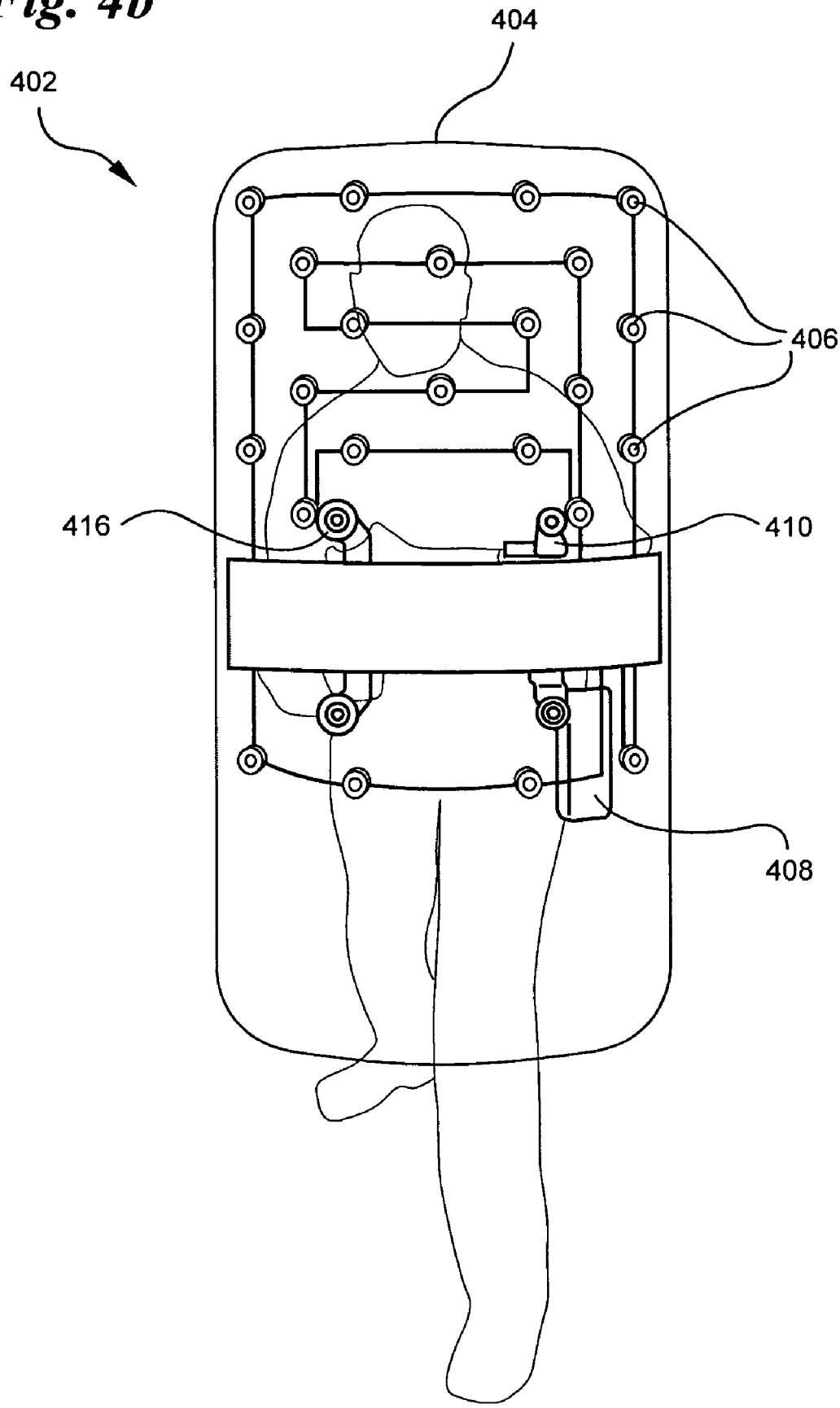

FIGS. 4*a* and 4*b* illustrate an embodiment of the invention as a shield dazzler 402. Dazzler 402 comprises a clear shield 404 of sturdy polymer material, such as Kevlar® by E. I. du Pont de Nemours and Company of Wilmington Del., suitable for protecting the user against projectiles. Mounted on shield 404 is a plurality of LEDs 406, each LED contained in reflecting optics. As stated above, a number of optical arrangements, such as concave reflectors or collimating lenses, will serve to concentrate and direct light emitted by LEDs 406. By way of example, the Luxeon® Star/O from Philips Lumileds Lighting Company comprises a high intensity LED with integrated optics in the form of a collimator, suitable for use in the shield dazzler as illustrated. Disposed on the user side of shield 404 and electrically connected to each LED 406 is power supply/driver circuitry 408, such as described above in reference to FIG. 1. Also disposed on the user side of shield 404 are handles 410 for a user to hold dazzler 402 when in use, as illustrated in FIG. 4*b*. Each square-bracket shaped handle 410 is firmly affixed to shield 404 by a bolt-washer-nut assembly 416 at each end of handle 410.

Figure 5:
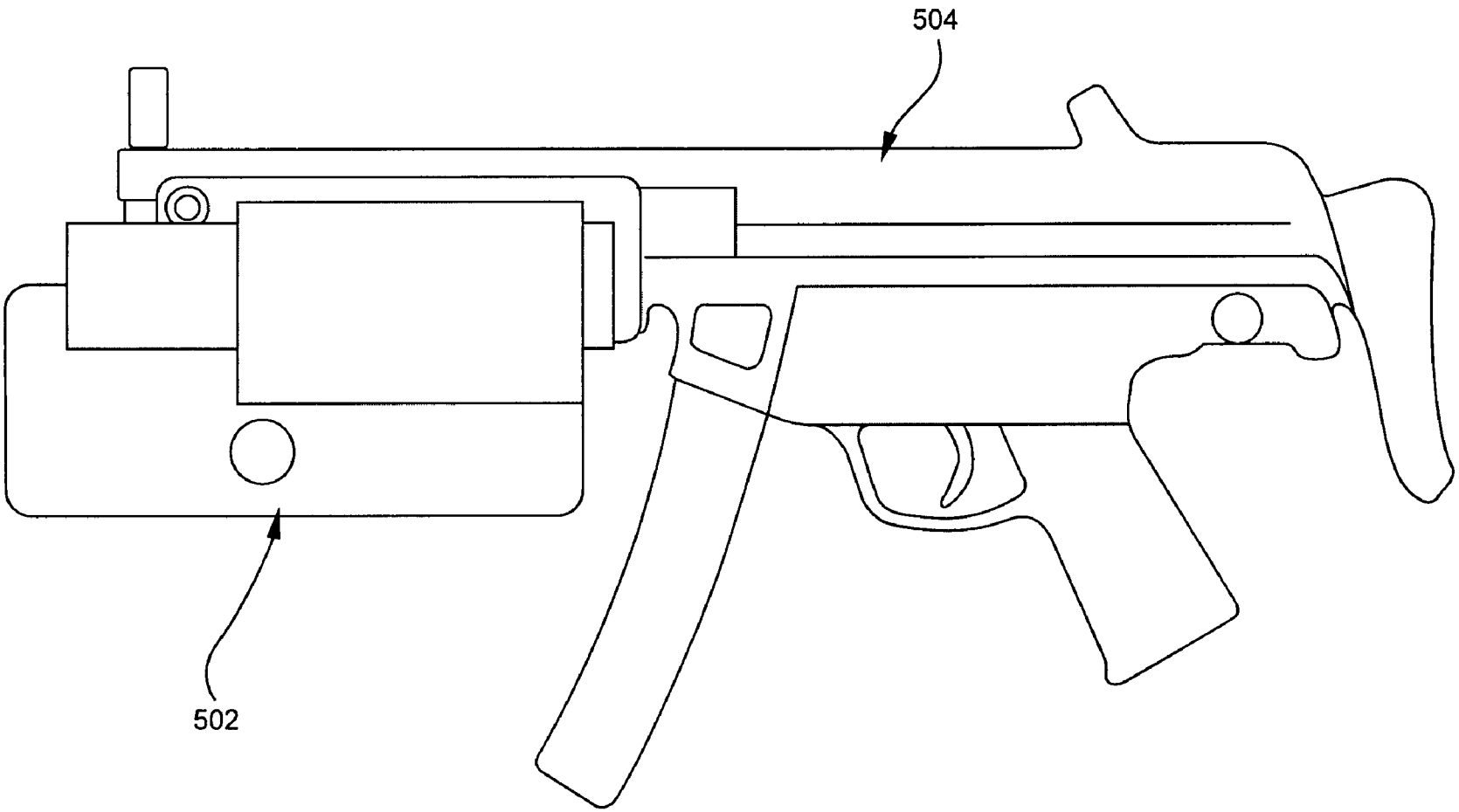
FIG. 5 illustrates an adaptation of the present invention as a handguard for a gun.

A long-range dazzler as illustrated in FIG. 3 may be adapted to a form factor suitable for mounting on hand-held weaponry, such as in the form of the handguard 502 for a gun 504 as illustrated in FIG. 5.

Many other adaptations of the invention are possible. Long range dazzlers, such as that depicted in FIG. 3, may be adapted for mounting on a vehicle for mobile applications. Alternatively, dazzlers may be fixed in strategic locations, such as security checkpoints, where dazzler capability enhances security.

As will be appreciated by those of skill in the art, the effectiveness of the dazzler functionality for threat deterrence can be enhanced by operation in conjunction with a high intensity directed acoustical device (HIDA), such as described in U.S. patent application number 20050286346. The disorientation caused by viewing dazzling light is enhanced when accompanied by high intensity sound. A HIDA may also be used for communicating speech to the target. Because of these utilities, it may be preferred to incorporate a HIDA into the dazzler. Suitable HIDAs are available, for example, from American Technology Corporation of San Diego, Calif.

Although the detailed descriptions above contain many specifics, these should not be construed as limiting the scope of the invention but as merely providing illustrations of some of the presently preferred embodiments of this invention. Various other embodiments and ramifications are possible within its scope.

While the invention has been described with a certain degree of particularity, it should be recognized that elements thereof may be altered by persons skilled in the art without departing from the spirit and scope of the invention. Further, while specific numbers and parameters have been set forth in keeping with the present state of the art, it will be understood that, if specifics of light emitting diode technology change over time, such numbers and parameters may be adjusted appropriately by persons of skill in the art and remain within the scope of the present invention. Accordingly, the present invention is not intended to be limited to the specific forms set forth herein, but on the contrary, it is intended to cover such alternatives, modifications and equivalents as can be reasonably included within the scope of the invention. The invention is limited only by the following claims and their equivalents.

We claim:

1. A non-lethal weapon apparatus for subduing a viewing subject in a target area, comprising;

a plurality of high intensity light emitting diodes emitting beams of high intensity light directed to a target area when current is provided to illuminate the light emitting diodes and at least one dedicated light emitting diode driver means for providing pulsed current to illuminate the light emitting diodes in high intensity light pulses, whereby the high intensity light pulses from the light emitting diodes are directed to the target area to produce a dazzling effect in a viewing subject.

2. A weapon according to claim 1, wherein the plurality of light emitting diodes forms an array, the array further comprising optical means for directing the beams of high intensity light emitted from the array to the target area.

3. A weapon according to claim 1, further comprising a power supply providing electrical power to the light emitting diodes and the driver means.

4. A weapon according to claim 1, further comprising a signal source providing signals to the driver means, wherein the driver means provides the pulsed current to illuminate the light emitting diodes in high intensity light pulses in response to signals from the signal source.

5. A weapon according to claim 1, further comprising a high intensity directed acoustical device.

6. A dazzler shield for subduing a viewing subject in a target area, comprising a shield surface having a user side and a target side, the shield surface affording protection on the user side from objects originating on the target side;

a plurality of high intensity light emitting diodes emitting beams of high intensity light directed from the target side to a target area when current is provided to illuminate the light emitting diodes and at least one dedicated light emitting diode driver means for providing pulsed current to illuminate the light emitting diodes in high intensity light pulses, whereby the high intensity light pulses from the light emitting diodes are directed to the target area to produce a dazzling effect in a viewing subject.

7. A dazzler shield according to claim 6, wherein the shield is adapted for handheld use.

8. A dazzler shield according to claim 6, wherein the shield surface is comprised of transparent polymer material.

* * * * *